United States Patent [19]

Jacquin et al.

[11] 4,397,739

[45] Aug. 9, 1983

[54] PROCESS FOR DESULFURIZING A CATALYTIC CRACKING OR STEAM CRACKING EFFLUENT

[75] Inventors: Yves Jacquin, Sevres; Chan T. Dinh, Le Vesinet; Manuel Gimenez-Coronado, Colombes; Jean Cosyns, Maule, all of France

[73] Assignee: Institut Francais du Petrole, Rueil-Malmaison, France

[21] Appl. No.: 235,799

[22] Filed: Feb. 19, 1981

[30] Foreign Application Priority Data

Feb. 19, 1980 [FR] France ..... 80 03646

[51] Int. Cl.[3] ..... C10G 23/02

[52] U.S. Cl. ..... 208/210; 208/211; 208/216 R

[58] Field of Search ..... 208/210, 211, 216 R

[56] References Cited

U.S. PATENT DOCUMENTS 2,793,170 10/1954 Stiles et al. .
3,732,155 5/1973 Cecil et al. ..... 208/210
3,804,748 4/1974 Nelson et al. ..... 208/211
4,083,771 4/1978 O'Hara ..... 208/216
4,098,682 7/1978 O'Hara ..... 208/216
4,334,982 6/1982 Jacquin et al. .

*Primary Examiner*—O. R. Vertiz
*Assistant Examiner*—Wayne A. Langel
*Attorney, Agent, or Firm*—Millen & White

[57] ABSTRACT

Catalytic cracking or steam cracking effluents are desulfurized without substantial decrease of their octane number by subdividing said effluent into two fractions of different boiling ranges, the heavier of which is admixed with hydrogen, the resulting mixture being completely vaporized and fed to a hydrodesulfurization zone containing a first bed of selective catalyst formed of cobalt and molybdenum, or cobalt and tungsten, or nickel and molybdenum or nickel and tungsten deposited on a non-acid carrier, and a second bed of conventional hydrodesulfurization catalyst, the effluent from the hydrodesulfurization zone being cooled down and fractionated to separate a hydrocarbon fraction of the gasoline range which is recombined with the lighter fraction of said effluent.

12 Claims, 1 Drawing Figure

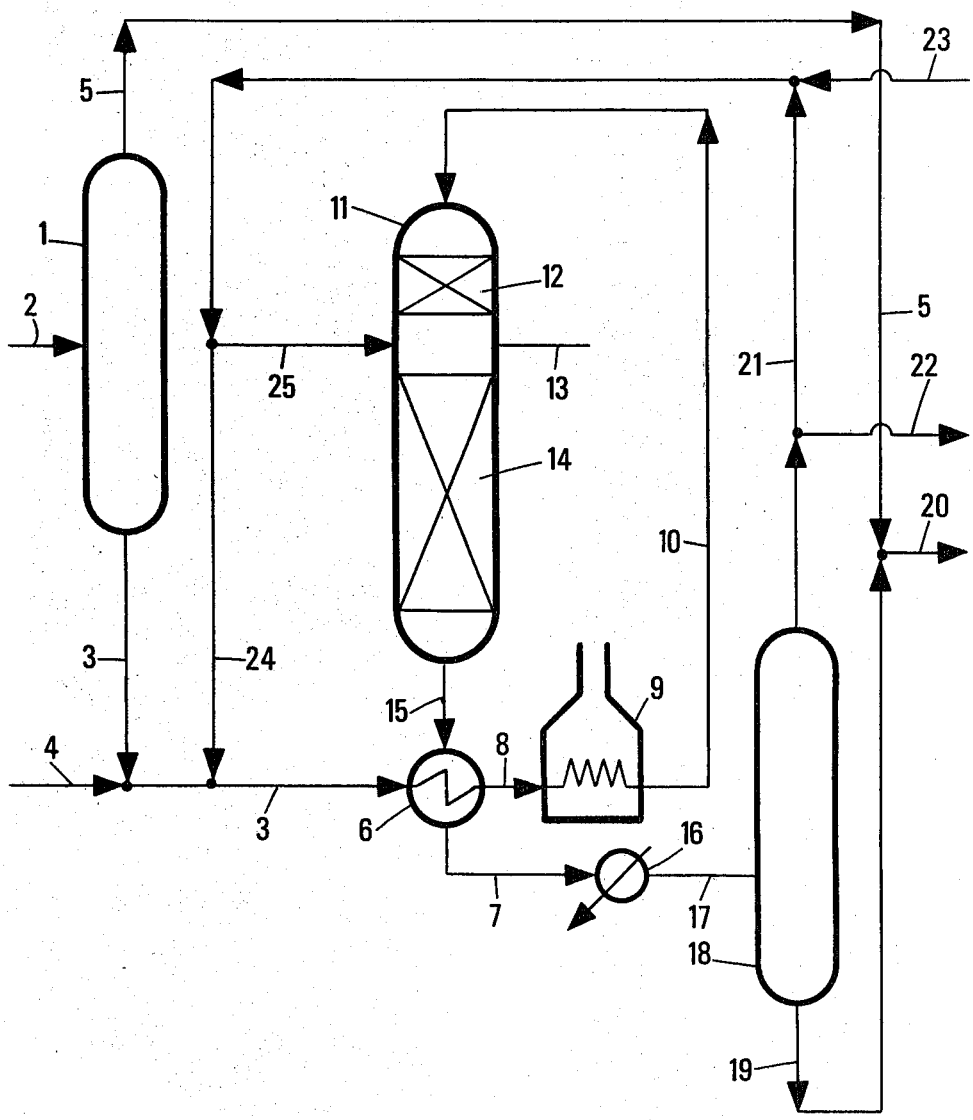
23
5
11
1
12
2
5
25
13
21
22
14
20
10
3
24
9
15
4
8
3
6
16
7
17
18
19

PROCESS FOR DESULFURIZING A CATALYTIC CRACKING OR STEAM CRACKING EFFLUENT

BACKGROUND OF THE INVENTION

The catalytic cracking or steam cracking gasolines are excellent basic constituents for producing commercial motor gasolines, owing to their high content of olefinic compounds and aromatic compounds which provide for a high clear octane number of these gasolines. Commonly the sulfur content of these gasolines (which may be defined as the fraction distilling between 30° and 220° C. for example) depends on the sulfur content of the heavy charge subjected to catalytic cracking. Up to now the sulfur content of these fractions was lower than those of the trade specifications, after admixture with gasolines obtained by other processes as, for example, catalytic reforming. A sweetening treatment of these gasolines was performed for removing compounds of the mercaptan type, which have a substantial corrosion effect and reduce the favourable effect, on the octane number, of lead additives.

This conventional treatment does not change substantially the total sulfur content of said gasoline.

Presently the increase of the sulfur content of the catalytic cracking or steam cracking charges and the decrease of the tolerable sulfur content of motor gasolines in the trade, give a further interest to a desulfurization treatment of these gasolines which removes the sulfur without changing to a substantial extent the octane number of these gasolines.

Different solutions have been proposed in order to obtain this result. According to U.S. Pat. No. 4,132,632 the entire cut 61°–197° C. (ASTM distillation) is treated on a catalyst comprising molybdenum oxide and cobalt oxide deposited on a carrier containing at least 70% of magnesia. The contents of active metals, calculated as oxides, are limited to the range from 0.5 to 2% for the cobalt family and from 4 to 6% for the molybdenum family. The ratios $CoO/MoO_3$ in the catalysts mentioned in the examples are those of the conventional hydrodesulfurization catalysts.

These proportions are defined by the ratio:

$$R = \frac{\text{element of Group VIII (Co)}}{\text{element of } Gr.\ \text{VIII (Co)} + \text{element of } Gr\ \text{VI (Mo)}}$$

wherein the active elements are expressed in gram-atoms, said ratio R being about 0.39 in the examples.

According to the U.S. Pat. No. 4,140,626 the total cut is also treated on a catalyst containing at least 70% of magnesia as MgO. The cobalt oxide and molybdenum oxide contents are such that the ratio $R = CoO/CoO + MoO_3$ of the prepared catalysts is close to 0.26 as in the conventional catalysts. The examples show that the catalysts prepared with alumina carriers are less active than those prepared with magnesia carriers and deactivate during time.

In the U.S. patent application Ser. No. 152,215 filed on May 25, 1980, now U.S. Pat. No. 4,334,982, it has been shown that the total cut may be treated on a hydrodesulfurization catalyst containing (a) a non-acid carrier selected from the group consisting of silica, aluminas of specific surface lower than 70 $m^2/g$, of the $\alpha$ type or tetragonal $\gamma$ type, cobalt, nickel, barium, magnesium and calcium aluminates carriers of a specific surface lower than 130 $m^2/g$, and autoclaved aluminas of specific surface lower than 135 $m^2/g$, and (b) at least cobalt and tungsten and/or cobalt and molybdenum, the total weight of cobalt and tungsten or of cobalt and molybdenum, expressed as oxide, being from 2 to 30% with respect to the total catalyst mass, the atomic ratio $$R = \frac{\text{cobalt}}{\text{cobalt} + (\text{molybdenum and/or tungsten})}$$

being higher than 0.55 (the metal concentrations being expressed in gram-atoms).

SUMMARY OF THE INVENTION

The present invention provides a process for lowering the sulfur or sulfur compounds content of a catalytic cracking or steam cracking gasoline boiling between 30° C. and 220° C., without substantially decreasing its octane number, comprising (1) fractionating said gasoline into (a) a light gasoline fraction boiling between the initial boiling point of said gasoline and a final boiling temperature T°C. comprised between 75° and 185° C., and (b) a heavy gasoline fraction boiling above T-20° C. and, in major part above T°C.;

(2) admixing said heavy gasoline fraction with a hydrogen containing gas;

(3) subjecting the resultant mixture to complete vaporization;

(4) feeding the resultant vaporized mixture to a hydrodesulfurization zone, said hydrodesulfurization zone containing (a) at least one bed of at least one selective catalyst containing (i) a non-acidic carrier and (ii) at least one pair of metals selected from the group consisting of cobalt and molybdenum, cobalt and tungsten, nickel and molybdenum, and nickel and tungsten, the total metal content of said selective catalyst, expressed as oxides, being from 2 to 30% with respect to the total weight of the selective catalyst, the atomic ratio $$R = \frac{\text{cobalt}}{\text{cobalt} + (\text{molybdenum or tungsten})} \text{ or } \frac{\text{nickel}}{\text{nickel} + (\text{molybdenum or tungsten})}, \text{ being}$$

from 0.55 to 0.90, and (b) at least one bed of a second hydrodesulfurization catalyst, said second catalyst containing cobalt and at least one additional metal, being a Group VIII, VII or VI metal, wherein the atomic ratio $$R' = \frac{\text{cobalt}}{\text{cobalt} + \text{additional metal}}$$

is lower than 0.55, the proportion by volume of the selective catalyst being from 5 to 90% with respect to the combined volumes of said selective catalyst and said second catalyst, said vaporized mixture being fed sequentially through the selective catalyst bed and then through the second catalyst bed;

(5) fractionating the hydrodesulfurization effluent and separately recovering a hydrogen-containing gas, and a hydrocarbon fraction distilling in the gasoline range; and (6) recombining the resultant hydrocarbon fraction boiling in the gasoline range with the light fraction from step (1), thereby producing a desulfurized gasoline having substantially the same octane number as said catalytic cracking or steam cracking gasoline.

BRIEF DESCRIPTION OF THE DRAWING

The FIGURE is a schematic representation of one embodiment of the present process.

DETAILED DISCUSSION

It has now been discovered as very advantageous for desulfurizing catalytic cracking or steam cracking gasolines, without any substantial decrease of the octane number, to separate the charge into two fractions: a light fraction and a heavy fraction of higher average molecular weight. The separation is performed in a flash tower or distillation column or in any device in which gasoline may be fractionated in two fractions of different average molecular weights.

The charge (usually distilling in the range from, for example, 30° to 220° C.) has generally a bromine number from 40 to 80 (g/100 g) and contains from 15 to 45%, more particularly from 20 to 40%, of olefins (essentially monoolefins with a small amount of diolefins; the maleic anhydride index is lower than 6 mg of maleic anhydride per gram (standard "UOP method" 326–58), and 15 to 25% of aromatic hydrocarbons. After fractionation of said charge, there is obtained, on the one hand, a light fraction whose boiling temperature is between the initial boiling point of the gasolines and a temperature from 75° to 185° C., preferably from 90° to 175° C., and, on the other hand, a heavy fraction containing 30 to 70% by volume of aromatic hydrocarbons, 3 to 35% by volume of olefinic hydrocarbons and whose boiling point is higher than T-20° C. and for the major part above T, T being the final boiling temperature of said light fraction in °C. The final boiling point of said heavy cut is substantially the same as that of the initial charge, i.e. before fractionation of the non-fractionated gasoline.

The process provides a gasoline whose octane number is substantially the same as that of the initial charge but whose sulfur content is lower than that of the initial charge, in contrast with most of the techniques for recovering gasolines from cracking (or steam-cracking) effluents, which either desulfurize directly the whole cracking (or steam-cracking) effluent, with a simultaneous decrease of the octane number (resulting from the loss of olefins) or do not subject the gasoline to any treatment, thereby maintaining its content of sulfur compounds, or proceed to a mere sweetening of the cracking effluent, which does not remove the sulfur compounds.

According to the invention, the so-defined heavy fraction is treated by making use of two separate catalyst beds: the first bed contains a selective catalyst which is one of the selective catalysts described in U.S. Pat. No. 4,334,982 (in this case the atomic ratio R of the catalyst is from about 0.55 to 0.90 and preferably from 0.70 to 0.80) or a catalyst comprising a carrier impregnated with nickel and molybdenum (or nickel and tungsten) wherein the total weight of nickel and molybdenum (or tungsten) expressed as oxide, is from 2 to 30% of the total catalyst weight, the atomic ratio R=nickel/nickel+molybdenum (or tungsten) being higher than 0.55 and lower than 0.90 preferably from 0.70 to 0.80.

The second bed contains a conventional hydrodesulfurization catalyst; i.e. a catalyst known in the art, particularly those containing cobalt and at least one additional metal, for example from groups VIII, VII or VI of the periodic classification of elements and wherein the atomic ratio R', defined in the same manner as the ratio R, i.e.

$$R' = \frac{\text{cobalt}}{\text{cobalt} + \text{additional metal}},$$

is lower than 0.55 and generally higher than 0.20. The bed of selective catalyst is arranged so as to be the first bed wherethrough passes the charge, said charge passing thereafter through the conventional catalyst bed. The proportion, by volume, of selective catalyst, with respect to the total catalyst amount, is from about 5 to 90% (preferably from 10 to 30%).

The catalysts are for example in the form of extrudates or balls of average diameter ranging from 1 to 6 mm. They preferably form a fixed bed in a reactor with concentration gradient.

Generally the catalysts are used in fixed bed but it is possible for at least one of the beds to be a moving bed.

When two superposed fixed beds of catalyst are used, the upper bed being that of selective catalyst and the lower bed that of conventional catalyst, the heavy fraction to be treated being introduced at the top of the selective catalyst bed and the reaction product effluent being withdrawn from the bottom of the conventional bed, it is preferred to effect an intermediary injection of cold hydrogen; said cold hydrogen is preferably at least partly recycle hydrogen and it has the effect of lowering the temperature of the flow of hydrocarbons and gas circulating through the hydrodesulfurization zone (quench).

This injection will be made at a point wherein about one third of the total catalyst volume is above the level of this injection point and about two thirds of the total catalyst volume below this level. Since the selective catalyst, as above mentioned, amounts to 5 to 90% of the total catalyst volume, it results that, when, for example, this volume is 5%, the injection of cold hydrogen (or quench) is performed in the conventional catalyst bed (this limit case can be considered as corresponding to 3 catalyst beds: a selective catalyst bed and two conventional catalyst beds; these 2 last beds being separated by the space for the hydrogen injection), and when this volume of selective catalyst is higher than about 33%, the cold hydrogen injection (or quench) is performed in the selective catalyst bed (this limit case can be considered as corresponding to 3 catalyst beds: 2 beds of selective catalyst, separated by the space for the hydrogen injection and a conventional catalyst bed).

FIG. 1 of the accompanying drawing illustrates the limit case where the injection of cold hydrogen is made between the two catalyst beds (volume of the selective catalyst: about 33% of the total catalyst volume).

A maximum optimization of the process according to the invention is achieved by passing the heavy fraction, before its introduction in the hydrodesulfurization reactor, through a heating system, in admixture with a gas of high hydrogen content, advantageously consisting, at least partly, of recycle gas. The fact that the heavy fraction is contacted with the gas of high hydrogen content before being fed to the heating enclosure (placed before the hydrodesulfurization zone) and not at the inlet of the hydrodesulfurization zone, avoids any partial polymerization in the heating enclosure of the olefinic components contained in the heavy fraction.

It is further of importance that the heating system or enclosure be equipped with at least one heat exchanger heavy fraction-hydrodesulfurization effluent and that the exchange area and the flow rate of the hydrogen-containing gas be so calculated as to completely vaporize the heavy fraction to be desulfurized. As a matter of fact, this complete vaporization of the heavy fraction prevents the plugging of the ducts which otherwise might result from partial polymerization of the olefins contained in the heavy charge; and this is more completely avoided by the injection, as above-mentioned, of a hydrogen containing gas into the heavy fraction, before said heavy fraction is introduced into the heating enclosure where it is vaporized. According to a preferred embodiment, the exchangers used for the vaporization are arranged in pairs so as to avoid stopping the unit operation for cleaning them.

The catalytic treatment with hydrogen of the heavy fraction is conducted at a temperature from 240° to 350° C., preferably from 260° to 330° C. (temperature at the reactor inlet). The pressure is from 5 to 60 bars, preferably from 7 to 50 bars. The space velocity, expressed in $m^3$ of injected liquid charge per $m^3$ of catalyst and per hour is generally from 0.5 to 15 and preferably from 1 to 8. The hydrogen partial pressure is generally from 4 to 60 bars and preferably from 5 to 40 bars. At the reactor outlet the reaction mixture is cooled down, the hydrocarbon fraction distilling in the gasoline range is condensed, then separated from a gas fraction of high hydrogen content which, preferably, is at least partly recycled in cold condition to the hydrodesulfurization reactor for the quench operation and is at least partly admixed to the charge before its passage through the exchanger and/or the heater. Irrespective of the sulfur concentration (particularly as $H_2S$) in the hydrodesulfurization zone, the hydrogen sulfide content of the recycle gas is preferably not greater than 8000 parts per million by volume (8000 vpm) more preferably not greater than 5000 vpm; higher values of the hydrogen sulfide content would require an increase of the purge rate or the removal, by washing, of a portion of the hydrogen sulfide in order to maintain its proportion in the recycle gas below 8000 or 5000 vpm. In any case it is nevertheless necessary to maintain a hydrogen sulfide content of the recycle gas higher than 150 vpm and preferably higher than 200 vpm in order to obtain a good selectivity of the catalyst.

Preferably, before use, at least one of the selective or conventional catalysts is subjected to a sulfiding step in the hydrodesulfurization reactor, before passage of the heavy fraction therethrough.

This sulfiding step provides for the incorporation into the catalyst of about 50 to 110% of the sulfur stoichiometrical amounts, calculated on the amounts of sulfides, for example, according to the metals involved, of formulas $Co_9S_8$, $MoS_2$, $WS_2$ and NiS.

This catalyst sulfiding step may be conducted, for example, at a temperature close to or higher than the reaction temperature selected for the hydrodesulfurization reaction, for a few hours, by means of a hydrogen sulfide mixture diluted with hydrogen (hydrogen sulfide proportion in the hydrogen of 0.5 to 5% by volume) at a convenient space velocity, for example of about 1000 to 3000 liters of gas, under normal temperature and pressure conditions, per liter of catalyst and per hour.

Another method, generally preferred, for sulfiding the catalyst, consists of passing over this catalyst a hydrocarbon charge boiling in the gasoline range (35° to 220° C.) completely free of olefins and diolefins, to which is added a sulfur-containing compound selected from the mercaptan family, sulfides or disulfides, preferably dimethyldisulfide. A straight-run gasoline, for example, would be convenient as hydrocarbon charge. The additional sulfur content is so adjusted as to obtain a sulfur content of the hydrocarbon used as hydrocarbon charge ranging from 0.2 to 2% by weight, preferably from 0.4 to 1%.

Since the selected hydrocarbon charge contains no olefins or diolefins, the at least partial vaporization of said charge taking place in the plant, is not accompanied with parasitic reactions (polymerization) which, after a time, are detrimental to the plant.

It has been discovered that these two catalyst sulfiding methods are particularly convenient in the present process, when conducted under the following new operating conditions of a stagewise operation: the one or more catalyst being placed in the reactor (wherein hydrodesulfurization will be subsequently performed, for example with at least one fixed bed), the above-defined sulfiding charge (mixture of hydrocarbon charge and sulfur compound or mixture of hydrogen sulfide diluted with hydrogen) is introduced into the reactor substantially at room temperature and the temperature at the inlet of the reactor is progressively increased up to a temperature T' higher than 250° C. but lower than 300° C., said temperature T' being preferably at least equal to the initial temperature which will be subsequently selected for conducting the hydrodesulfurization reaction and for example of about 280° C., said selected temperature being then maintained constant during a period sufficient for introducing in the catalyst a sulfur amount at least equal to the sulfur amount corresponding to the complete conversion to sulfides of the oxides contained in the catalyst.

After this first temperature stage, the temperature at the reactor inlet is progressively increased to a level T'' from 30° to 50° C. higher than temperature T' of the preceding stage and this second temperature T'' is maintained for at least two hours, while continuing to introduce in the reactor a mixture hydrocarbon charge-sulfur compound at a space velocity selected from one half to twice the space velocity which will be subsequently chosen for the admission of the heavy fraction to be desulfurized (or of the hydrogen sulfide - hydrogen mixture at a V.V.H. from 1000 to 3000 calculated in liters of gas, under normal conditions, per liter of catalyst and per hour). Optionally a third stage may be performed at a temperature from 20° to 40° C. higher than in the second stage, said third stage lasting at least two further hours with the same space velocity as in the second stage.

A simplified flow-sheet of the unit is shown by way of non-limitative illustration of the invention, in the single figure of the accompanying drawing.

The total gasoline fraction issued from a catalytic cracking unit is introduced through line 1 in a distillation column 2 wherein a light gasoline olefinic fraction, not subjected to the treatment and conveyed through line 5, is separated from a heavy gasoline fraction conveyed through line 3. This heavy fraction is admixed with a hydrogen-containing gas, which, in the embodiment shown on the figure, consists of recycle gas supplied through line 24, and fed to the heat exchanger 6 where it is completely vaporized. The vaporized heavy fraction is supplied, through lines 8 and 10, to the top of the hydrodesulfurization reactor 11, optionally after passage through the heater 9. The reactor 11 contains two catalysts as above explained. A "quench" is performed in reactor 11, by means of the recycle gas injected through line 25 at a point of the reactor where the catalyst mass is divided into two beds 12 (selective catalyst bed) and 14 (conventional catalyst bed) separated by a space 13, the volume of the bed 14 being substantially twice that of the bed 12. It has been previously stated that the catalyst may be subjected to a preliminary sulfiding before the hydrodesulfurization step. This sulfiding step may, for example, be performed with a sulfur compound in the presence of a hydrocarbon charge, as above defined, which is introduced, in this embodiment, through line 4. The effluent of the hydrodesulfurization reactor 11 is withdrawn from line 15, passes through exchanger 6 and ducts 7 and 17 and reaches the separator 18, optionally after passage through the cooler 16. From separator 18 there is recovered a liquid fraction boiling in the gasoline range which is withdrawn through line 19 and is admixed, in totality or partly, with the non-treated fraction, conveyed through line 5. The mixture may be supplied, through line 20, to a sweetening unit or directly to the gasoline pool. At the top of the separator 18 there is obtained, through line 21, a gas fraction (formed essentially of hydrogen) which, for example, is purged through line 22, (or whose $H_2S$ content is decreased by any other suitable means, for example by washing). Most of this gas fraction, forming the recycle gas, is supplied at least partly, through lines 21 and 25, to the quench, at the level of space 13, if necessary, and the major portion thereof is supplied, through line 24, to line 3, before the exchanger 6. Additional fresh hydrogen can be introduced through line 23, for example from the gas withdrawn from a catalytic reforming unit.

The following examples illustrate the invention.

EXAMPLE 1. (comparative)

This example concerns the treatment of a catalytic cracking gasoline whose characteristics are reported in Table I. This gasoline will be called "total gasoline". It is subdivided into two fractions, by distillation. The characteristics of these two fractions are indicated in Tables II and III. The light fraction of Table II, boiling below 100° C., will be called "light gasoline 100⊖" and the heavy fraction of Table III, boiling above 100° C. "heavy gasoline 100⊕"

TABLE I

| CHARACTERISTICS OF THE CATALYTIC CRACKING GASOLINE. Total gasoline | | |
|---|---|---|
| Specific gravity d4/15 | g/cm³ | 0.738 |
| ASTM distillation | pi | 33° C. |
| | 5% volume | 49 |
| | 10% volume | 53 |
| | 20% volume | 60 |
| | 30% volume | 69 |
| | 40% volume | 80 |
| | 50% volume | 95 |
| | 60% volume | 113 |
| | 70% volume | 133 |
| | 80% volume | 155 |
| | 90% volume | 180 |
| | 95% volume | 198 |
| | Final point | 207 |
| | Distillate | 98% |
| | Residue | 1.8% |
| | Losses | 0.2% |
| Bromine member (g of bromine/100 g) | | 47.3 |
| Total S content: (ppm) | | 1625 |

TABLE I-continued

| CHARACTERISTICS OF THE CATALYTIC CRACKING GASOLINE. Total gasoline | |
|---|---|
| Clear motor octane number: | 91.8 |

The heavy gasoline 100⊕ is admixed with hydrogen and the mixture is vaporized in the hydrodesulfurization reactor.

TABLE II

| CHARACTERISTICS OF THE LIGHT GASOLINE FRACTION 100⊖. | |
|---|---|
| % by weight of the total gasoline | 49.6% |
| Specific gravity $d_{15}^4$ (g/cm³) | 0.671 |
| TBP distillation point | 35–100° C. |
| Total sulfur content (ppm) | 158 |
| Bromine number (g of bromine/100 g) | 76 |
| Clear motor octane number | 92.6 |

TABLE III

| CHARACTERISTICS OF THE HEAVY GASOLINE FRACTION 100⊕. | |
|---|---|
| % by weight of the total gasoline | 50.4% |
| Specific gravity $d_{15}^4$ (g/cm³) | 0.818 |
| TBP distillation point | 100–220° C. |
| Total sulfur content (ppm) | 3071 |
| Bromine number (g of bromine/100 g) | 19 |
| Clear motor octane number | 90.8 |

The following two catalysts A and B are used successively:

The characteristics of catalyst A are reported in Table IV. The atomic ration R=cobalt/cobalt+molybdenum is equal, in the present case, to 0.28. This catalyst, whose ratio R is lower than 0.55, must not be used alone in the process according to the invention.

However it has been ascertained that it can be used, in accordance with the invention, with the provision of a preceding selective catalyst bed such as B, as defined below.

The catalyst B (whose characteristics are reported in Table IV) is prepared as follows:

4% by weight of nickel oxide is incorporated to a transition alumina carrier of a BET surface equal to 250 m²/g and a total pore volume of 0.6 cc/g, by means of a nickel nitrate solution. The catalyst is then dried and roasted at 800° C. for 2 hours. Its measured specific surface is then 173 m²/g. To this carrier, called "nickel aluminate", are incorporated, by the impregnation technique, 7.5% of nickel oxide and 7.7% of molybdenum oxide and the resulting product is roasted at 500° C. for 2 hours. The atomic ratio R=Ni/Ni+Mo in this case is 0.74.

The catalysts A and B are used as fixed beds and the reactants are flowing downwardly. The heavy gasoline fraction 100+ is treated in the conditions indicated in Table V. In this table the space velocity (V.V.H.) is expressed by the flow rate of charge in cm³ per hour and per cm³ of catalyst. The hydrogen flow rate is expressed in hydrogen liters per liter of liquid charge.

TABLE IV

| CHARACTERISTICS OF THE CATALYSTS | | | | | | | |
|---|---|---|---|---|---|---|---|
| CATALYST TYPE | S: $m^2/g$ | PORE VOLUME $cm^3/100$ g | METAL OXIDE CONTENT IN % BY WEIGHT $MoO_3$ | CoO | NiO | $WO_3$ | NATURE OF THE CARRIER |
| A | 200 | 52 | 14 | 3 | 0 | 0 | γ transition alumina |
| B | 146 | 51 | 7.7 | 0 | 11.5 | 0 | Nickel aluminate type |

The catalysts are presulfided before the test by means of a mixture of hydrogen with 3% by volume of hydrogen sulfide. The sulfiding gas is injected in cold condition and the treatment is then conducted for 2 hours at 280° C., then 2 hours at 320° C. and finally 3 hours at 350° C. The flow rate of presulfiding gas is 100 l/hour per 20 $cm^3$ of catalyst.

The desulfurized heavy gasoline fraction 100⊕ is admixed (in the proportions of the distillation) with the 100⊖ fraction and the properties of the so-reconstituted gasoline are determined.

The results of the test performed with each of the catalysts A and B are reported in Table V.

The results of test 1 show that catalyst A is too active but not selective. In test 2, still with catalyst A, the operating conditions are modified but only a poor selectivity is obtained and a continuous deactivation of the catalyst is observed. In test 3, conducted with the selective catalyst B, the operation is performed at 260° C. for 200 hours and the temperature is then increased by 20° C. (up to 280° C.) and the performance is ascertained after 200 hours in the new conditions (total duration of the test: 400 hours). It has been verified that, between the 20th and the 200th hour of the test, no significant deactivation occurs. The reconstituted gasoline obtained with the use of catalyst B has very good performances as far as the activity and the selectivity are concerned (low decrease of the bromine and the octane numbers).

TABLE V

| TESTS WITH A SINGLE CATALYST IN THE REACTOR | | | | | | | | | | | | | | |
|---|---|---|---|---|---|---|---|---|---|---|---|---|---|---|
| | | | | | | | CHARACTERISTICS OF DESULFURIZED HEAVY GASOLINE | | | CHARACTERISTICS OF THE MIXTURE OF DESULFURIZED HEAVY GASOLINE AND NON TREATED LIGHT GASOLINE | | | | |
| TEST No. | CATALYST | AGE OF CATALYST in H. | VVH | T° C. | HYDROGEN FLOW rate 1/1 | PRESSURE $kg/cm^2$ | IBr in g/100 g | S in ppm | Clear $F_1NO$ | IBr in g/100 g | S in ppm | Clear $F_1NO$ | HDS* % | HDO** % |
| 1 | A | 40 | 4 | 280 | 350 | 30 | 0.5 | 2 | 84 | | | | | |
| 2 | A | 40 | 4 | 280 | 200 | 20 | 2 | 4 | 86 | 38.5 | 79 | 89.5 | | |
| | | 80 | 4 | | | | 8 | 50 | | | | | | |
| | | 200 | 4 | | | | 12 | 70 | | | | | | |
| 3 | B | 40 | 4 | 260 | 350 | 30 | 7 | 210 | | | | | | |
| | | 200 | 4 | 260 | 350 | 30 | 8 | 203 | 86.5 | 41.7 | 181 | 90.9 | 88.9 | 11.8 |
| | | 400 | 4 | 280 | 350 | 30 | 3.5 | 30 | | 39.5 | 93.5 | 90.5 | 94.2 | 16.5 |

Non-treated light gasoline: fraction distilling below 100° C. (see Table II)
IBr: 76 clear $F_1ON$ = 92.6 S = 158 ppm
Heavy gasoline to be desulfurized: fraction distilling above 100° C. (see Table III)
IBr = 19 clear $F_1ON$ = 90.8 S = 3071 ppm
*HDS % = Hydrodesulfurization (% by weight)
**HDO % = Loss of olefins by hydrogenation, measured in % of bromine number lost.

EXAMPLE 2

First test (comparative)

A composite bed is formed of 20% by weight of catalyst B placed in the reactor on the side of the charge inlet and 80% by weight of catalyst A placed on the side of the hydrocarbon outlet. The charge consists of the total gasoline used in example 1, without any preliminary fractionation.

Second test (according to the invention)

The same composite bed of catalyst as in the first test is used but with a charge of heavy gasoline fraction 100⊕. After treatment, the treated fractions 100⊕, are admixed with the non-treated fractions 100⊖ in the same proportions as in the total gasoline.

The two tests are conducted for 200 hours with a V.V.H. of 4, a hydrogen flow rate of 350 l/h, a pressure of 30 $kg/cm^2$ and a temperature of 280° C.

The results of the two tests are summarized in Table VI. The reconstituted gasolines, after 200 hours of run, are distilled according to the ASTM distillation test and the following results are obtained:

| | 95% point | Final point | residue |
|---|---|---|---|
| First test of example 2 | | | |
| Treatment of total gasoline catalyst B + A after 200 hours | 198° C. | 209° C. | 0.5% |
| Second test of example 2 | | | |
| Treatment of heavy fraction catalyst B + A after 200 hours | 197° C. | 207° C. | 0.6% |

In the second test, after the mixing of the 100⊕ fraction treated according to the invention with the 100⊖ fraction, there is obtained a mixture whose characteristics are as follows:

IBr (g Br/100 g): 41.9 S(ppm): 87

HDS:94.7% $F_1$ clear ON: 91.0.

The tests show that, in order to maintain the octane number value, a hydrodesulfurization of the heavy fraction (100° C.+) is far more advantageous than the hydrodesulfurization of the total gasoline. The combination of a specific catalyst for the treatment of unsaturated hydrocarbons with a conventional HDS (hydrodesulfurization) catalyst is stable and does not result in the formation of heavy fractions: when operating in the presence of a conventional catalyst, such as A, alone (see second test of example 1), a substantial deactivation of said catalyst and the formation of heavy fractions in the treated products are observed.

When operating in the presence of only the selective catalyst B, not combined with the conventional catalyst A, satisfactory results are observed after 200 hours ($F_1ON$ of the reconstituted gasoline similar to that obtained in example 2, although slightly lower); however, after 200 hours, the reconstituted gasoline, after use of catalyst B, has a I Br or Br N number of 41.7 (HDO %=11.8), whereas, after use of the mixture A+B, the reconstituted gasoline has a I Br (or Br N) number of 41.9 (HDO %=11.4).

Similarly it is observed that, after 400 hours, the sulfur content of the heavy fraction 100⊕ is 203 instead of 21 in the second test of example 2, so that, in the recombined gasoline, the sulfur content (after use of catalyst B alone) is 181 (HDS yield: 88.9% instead of 87 (HDS yield: 94.7%) with the use of the catalyst mixture of A and B.

TABLE VI

| | Nature of the treated charge | | | | | |
|---|---|---|---|---|---|---|
| | FRACTION 100+ | | | MIXTURE OF FRACTIONS 100+ and 100− | | |
| | Br N gBr/-100 g | S ppm | CLEAR $F_1ON$ | Br N gBr/-100 g | S ppm | CLEAR $F_1ON$ |
| First test | | | | | | |
| (Catalysts B + A) | | | | | | |
| 40 h | | | | 4.5 | 5 | |
| 80 h | | | | 4 | 4 | 83.6 |
| 200 h | | | | 4.5 | 5 | 83.8 |
| Second test | | | | | | |
| Catalysts B + A after | | | | | | |
| 40 h | 5 | 20 | | | | |
| 80 h | 4 | 18 | | | | |
| 200 h | 5 | 21 | 86.9 | | | |

What is claimed is:

1. A process for lowering the sulfur or sulfur compounds content of a catalytic cracking or steam cracking gasoline boiling between 30° C. and 220° C., without substantially decreasing its octane number, comprising (1) fractionating said gasoline into (a) a light gasoline fraction boiling between the initial boiling point of said gasoline and a final boiling temperature T° C. comprised between 75° and 185° C., and (b) a heavy gasoline fraction boiling above T-20° C. and, in major part above T° C.;

(2) admixing said heavy gasoline fraction with a hydrogen-containing gas;

(3) subjecting the resultant mixture to complete vaporization;

(4) feeding the resultant vaporized mixture to a hydrodesulfurization zone, said hydrodesulfurization zone containing (a) at least one bed of at least one selective catalyst containing (i) a non-acidic carrier and (ii) at least one pair of metals selected from the group consisting of cobalt and molybdenum, cobalt and tungsten, nickel and molybdenum, and nickel and tungsten, the total metal content of said selective catalyst, expressed as oxides, being from 2 to 30% with respect to the total weight of the selective catalyst, the atomic ratio $$R = \frac{\text{cobalt}}{\text{cobalt + (molybdenum or tungsten)}} \text{ or}$$

-continued $$\frac{\text{nickel}}{\text{nickel + (molybdenum or tungsten)}}, \text{ being}$$

from 0.55 to 0.90, and (b) at least one bed of a second hydrodesulfurization catalyst, said second catalyst containing cobalt and at least one additional metal, being a Group VIII, VII or VI metal, wherein the atomic ratio $$R' = \frac{\text{cobalt}}{\text{cobalt + additional metal}}$$

is lower than 0.55, the proportion by volume of the selective catalyst being from 5 to 90% with respect to the combined volumes of said selective catalyst and said second catalyst, said vaporized mixture being fed sequentially through the selective catalyst bed and then through the second catalyst bed;

(5) fractionating the hydrodesulfurization effluent and separately recovering a hydrogen-containing gas, and a hydrocarbon fraction distilling in the gasoline range; and (6) recombining the resultant hydrocarbon fraction boiling in the gasoline range with the light fraction from step (1), thereby producing a desulfurized gasoline having substantially the same octane number as said catalytic cracking or steam cracking gasoline.

2. A process according to claim 1, wherein at least one of the selective catalyst or the second catalyst is presulfided.

3. A process according to claim 2, wherein said catalyst is presulfided by means of a sulfiding method comprising placing the catalyst in the zone which will be subsequently used as the hydrodesulfurization zone, and treating it with a sulfiding agent consisting essentially of a mixture of hydrogen sulfide with hydrogen, or with a mixture of a sulfur compound with a hydrocarbon charge free of unsaturated olefinic compounds, said sulfiding method further comprising injecting the sulfiding agent on the catalyst at room temperature, and wherein the temperature at the inlet of said zone, which will be subsequently used as hydrodesulfurization zone, is progressively increased up to a temperature T′ from 250° to 300° C., said selected temperature being maintained for a time sufficient to inject on the catalyst a sulfur amount at least equal to the sulfur amount corresponding to the complete conversion to sulfides of the oxides contained in the catalyst, the inlet temperature in said zone is increased to a level exceeding the previously selected temperature T′ by 30° to 50° C., the injection of the sulfiding agent being continued at said new temperature T″ for at least two hours, at a space velocity intermediate between one half and twice the space velocity which will be subsequently selected for the admission of said heavy gasoline fraction.

4. A process according to claim 3, wherein the sulfiding agent is injected on the catalyst at room temperature, the inlet temperature of the zone to be used subsequently at the hydrodesulfurization zone is progressively increased up to a temperature T′ between 250° and 300° C., said temperature being selected at least equal to the inlet temperature chosen for the subsequent hydrodesulfurization reaction, the sulfiding temperature is increased by 30° to 50° C. and the resulting temperature is maintained for at least two hours, and wherein this sulfiding temperature is further increased by 20° to 40° C., the resulting temperature being maintained for at least two additional hours.

5. A process according to claim 1, wherein the hydrodesulfurization zone comprises two superposed fixed beds of catalysts, one of the beds being formed of selective catalyst and the other of the second catalyst, the fixed bed of selective catalyst being disposed above the bed of the second catalyst, the mixture of the hydrogen-containing gas with the heavy fraction being introduced at the upper part of the selective catalyst bed and the hydrodesulfurization effluent being withdrawn from the lower part of the second catalyst bed, said process further comprising injecting cold hydrogen in the hydrodesulfurization zone at a point wherein about one third of the total catalyst volume is above the level of the cold hydrogen injection.

6. A process according to claim 5 wherein the cold hydrogen comprises, at least in part, hydrogen containing gas recovered in step (5).

7. A process according to claim 1, wherein the hydrogen-containing gas admixed with the heavy gasoline fraction in step (2) comprises, at last in part, hydrogen-containing gas recovered in step (5).

8. A process according to claim 7, wherein the hydrogen sulfide content of the recycled hydrogen-containing gas is not greater than 8000 volume parts per million and greater than 150 volume parts per million.

9. A process according to claim 1, wherein the hydrodesulfurization is effected at a temperature of 240°–350° C. at the reaction inlet, a pressure of 5–60 bars, a space velocity of 0.5–15 $m^3$ of injected liquid charge per $m^3$ of catalyst and per hour, and a hydrogen partial pressure of 4–60 bars.

10. A process according to claim 9, wherein said temperature is 260°–330° C., said pressure is 7–50 bars, said space velocity is 1–8 $m^3$ liquid charge per $m^3$ catalyst and per hour, and said hydrogen partial pressure is 5–40 bars.

11. A process according to claim 1 wherein the proportion by volume of the selective catalyst is from 10 to 30% of the combined volumes of the selective catalyst and the second catalyst.

12. A process according to claim 1 wherein the atomic ratio R is from about 0.70 to 0.80.

* * * * *